United States Patent [19]

Nevins et al.

[11] Patent Number: 4,542,053

[45] **Date of Patent: * Sep. 17, 1985**

[54] BONDING SYSTEM FOR WEAR SURFACES

[75] Inventors: Norman Nevins, Dayton; Robert L. McVay, Cincinnati; Carmen L. Bellanca, Centerville, all of Ohio

[73] Assignee: Protective Treatments, Inc., Dayton, Ohio

[ * ] Notice: The portion of the term of this patent subsequent to Sep. 3, 2000 has been disclaimed.

[21] Appl. No.: 517,539

[22] Filed: Jul. 27, 1983

Related U.S. Application Data

[63] Continuation-in-part of Ser. No. 234,909, Feb. 17, 1981, Pat. No. 4,403,005.

[51] Int. Cl.[4] ..... B32B 25/14; B32B 25/18

[52] U.S. Cl. ..... 428/48; 428/54; 428/462; 428/519; 428/520; 428/521; 428/522

[58] Field of Search ..... 428/47, 48, 54, 462, 428/522, 519, 520, 521; 52/309.1, 309.3, 389, 390; 525/144; 524/496, 523, 525, 527

[56] References Cited

U.S. PATENT DOCUMENTS

| | | | |
|---|---|---|---|
| 2,996,472 | 8/1961 | Gessler et al. | 524/496 |
| 3,896,245 | 7/1975 | Seto et al. | 428/231 |

FOREIGN PATENT DOCUMENTS

| | | | |
|---|---|---|---|
| 2536397 | 2/1977 | Fed. Rep. of Germany | 524/525 |

*Primary Examiner*—Paul J. Thibodeau

*Attorney, Agent, or Firm*—Killworth, Gottman, Hagan & Schaeff

[57] ABSTRACT

A wear surface such as steel bridge deck surfaced with a wear-resistant overlay such as plastic tiles is disclosed in which the tiles are bonded to the deck by means of a bonding layer having preferably a shore 00 hardness of from approximately 78 to 90 and comprising an elastomer compounded with a stiffening filler in an amount equal to at least about half the weight of the elastomer. Low volatile liquid plasticizer is present in an amount to provide the stated hardness. The elastomer is preferably a mixture of acrylic elastomer and butyl elastomers, and the stiffening filler is a high abrasion furnace carbon black. The tiles are adhered to the layer with a solution coating comprising neoprene in admixture with a terpene-phenolic resin and the coating desirably includes a hydrophobic silica.

6 Claims, 1 Drawing Figure

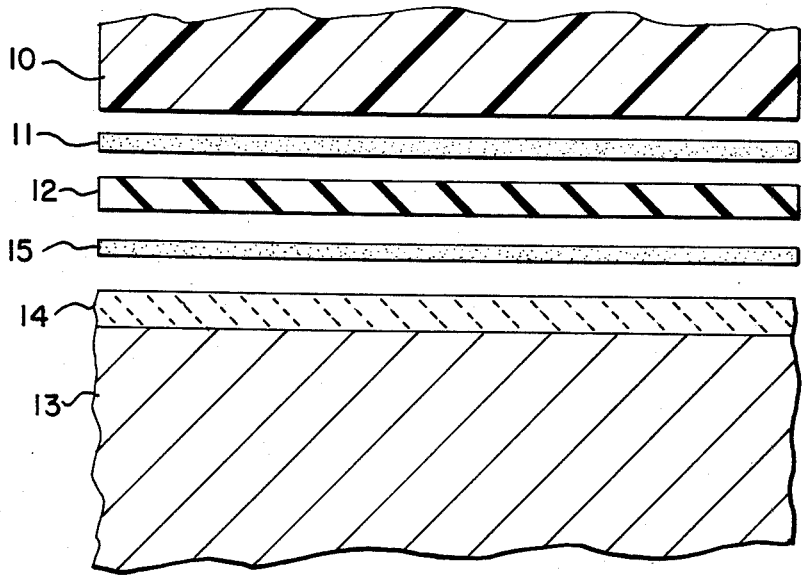
10
11
12
15
14
13

BONDING SYSTEM FOR WEAR SURFACES

CROSS-REFERENCE TO RELATED APPLICATIONS

This application is a continuation-in-part of our earlier application Ser. No. 234,909, filed Feb. 17, 1981, now U.S. Pat. No. 4,403,005, issued Sept. 6, 1983 the disclosure of which is hereby incorporated by reference.

BACKGROUND OF THE INVENTION

1. Technical Field

This invention relates to the bonding of wear resistant overlays to wear surfaces, and it includes protection of steel bridge decks which tend to corrode, particularly when salt is applied during the winter to prevent icing.

2. Background Art

Plastic tiles, and especially molded fiber-filled polyurethane tiles, are now being tested for use as wear resistant overlays for wear surfaces such as bridge decks which carry vehicular traffic. Bonding such wear resistant overlays to a steel bridge deck presents particular problems because of a tendency for tiles to move and be pushed out of place by the pressure of the vehicles passing thereover, and, also, because the adhesive system which holds the tiles in place must protect the steel surface of the bridge from corrosion. It is here intended to provide a bonding system which will hold the tiles in place and which will protect the steel bridge deck surface from the corrosive tendency of the weather and from salt applied in the winter in order to minimize icing. This bonding system must be able to sustain itself under widely varying conditions of temperature, humidity and mechanical stress.

SUMMARY OF THE INVENTION

We have found that a properly filled and plasticized elastomer layer can be bonded to the tile and to the bridge deck with the layer being soft enough to avoid cracking at a low temperature while, at the same time, being stiffened sufficiently to prevent the impact of passing vehicles from squeezing the layer out from between the bridge deck and the tiles thereby preventing delamination of the tiles from the deck. Such an elastomer layer is plasticized to have a Shore 00 hardness of in the range of 60–95, preferably approximately 78 to 90, and adequate stiffness is provided by using a stiffening filler, especially carbon black, preferably in an amount at least equal to about half the weight of the elastomer, and more preferably at least equal to about the weight of the elastomer. Most satisfactory stiffening is achieved using a carbon black designated ASTM N-330 which provides greater stiffness than any other stiffening filler. Carbon blacks designated ASTM N-326, N-347 and N-351 are also suitable. These preferred carbon blacks are known as high abrasion furnace blacks; although, it should be realized that other carbon blacks can be used as well.

The elastomer is preferably a mixture of (1) a butyl rubber having a molecular weight of at least about 300,000, (2) a butyl rubber which is cross-linked, as by the presence of 0.5–3% of divinyl benzene, to provide a solubility in cyclohexane of about 15% to about 25%, and (3) a small proportion of an elastomer such as acrylic polymers, acyronitrile-butadiene copolymers, or chlorinated hydrocarbon polymers. A suitable acrylic elastomer is a high molecular weight polyacrylate or polymethacrylate having a $T_g$ in the range of −10° C. to −40° C., preferably −15° C. to −25° C. Oils, greases, gasoline drippings, and the like, swell butyl rubber, and the presence of the acrylic elastomer prevents excessive swelling. A weight ratio of from 1:10 to 1:4 (acrylic to butyl) represents an appropriate proportion of the acrylic elastomer. A typical acrylic elastomer is provided by copolymerizing in bulk a blend of ethyl acrylate and butyl acrylate which provides a $T_g$ of −18° C. As is well known, $T_g$ identifies the glass transition temperature which is a known quantity for each monomer. The $T_g$ of the blend can be calculated from the $T_g$ of each monomer and its proportion in the copolymer which is formed.

The plasticizers which can be used are illustrated by processing oil which is a low molecular weight polyisobutylene, but a large variety of low volatile liquid softeners are also useful, and these are more fully illustrated in Seto and Thompson U.S. Pat. No. 3,896,245 issued July 22, 1975.

The elastomer layer will normally have a minimum thickness of approximately 0.030 inch, and preferably 0.125 inch. The layers may have any desired width and may be tile length or longer (in which case the layer is supplied as a coil wound together with a separating layer). The layer is formed by extrusion, and it is difficult to extrude very thin layers. This provides a practical factor which bears upon the minimum thickness. Cost bears upon the maximum thickness.

In order to bond the elastomer layer to the tile, it must be recognized that molded tiles may be surfaced with mold release agents which may interfere with the wetting of the tile and the achievement of a good bond. We have found that adhesion of the tile to the butyl elastomer layer or of the butyl elastomer layer to other surfaces (primed or improved) can be promoted by using a coating containing neoprene in admixture with a terpene-phenolic resin, these being applied to the butyl elastomer layer (either or both sides), or to the surface or surfaces which the butyl elastomer layer is to contact, from an organic solvent solution of the mixed resins.

Neoprene (chemically known as polychloroprene) is known for use in contact adhesives which supply a tacky surface, but the tile coatings which are used herein exhibit no surface tack when dried. Despite the lack of tack, the coated and dried tile surface bonds strongly to the elastomer layer on the application of pressure. Neoprene W provides distinctly superior results, and is preferred. Neoprene W is constituted by about 85% by weight of the trans isomer of polychloroprene, and it is preferred to use a neoprene having a trans isomer content of at least about 60%.

Terpene-phenolic resins are themselves known materials. These are non-heat hardening condensates of formaldehyde with a mixture of pinene and a phenol. The pinene may be alpha or beta pinene or a mixture thereof, and the phenol may be any of the usual phenols used in phenol-formaldehyde resins, such as t-butyl phenol or para-octyl phenol. The pinene component will constitute from approximately 10% to 40% by weight of the mixture thereof with the phenol component. The proportion of formaldehyde is determined by the desired non-heat reactive nature of the condensate. A typical terpene-phenolic resin available in commerce can be obtained from Reichhold Chemical under the designation Nirez-2040.

The terpene-phenolic resin is used in admixture with the neoprene resin in a weight ratio of 1:3 to 3:1, preferably a ratio of 1.2:1 to 1:1.2. This preferred ratio represents a larger amount of the terpene-phenolic resin than would normally be considered to be appropriate in a contact adhesive.

The organic solvent selected for use in these coatings is of little importance, methyl ethyl ketone being an illustrative useful solvent.

The solution of neoprene and terpene-phenolic resin importantly includes a hydrophobic silica in an amount of at least about 60% of the weight of the neoprene, such as Aerosil 972 (Degussa) to provide resistance to water in combination with superior adhesion. Up to about 100% of silica, based on the neoprene, can be accepted.

An amino silane adhesion promoter may also be present. These are known and are conventional for this purpose.

Depending on the type of wear surface to which the tile is to be bonded, it may be desirable to coat or prime that surface. For example, a corrosion-resistant bond is desirable to hold the elastomer layer to a steel bridge deck. A preferred steel deck primer is Dimetcote 9 from Ameron Corp., Protective Coatings Division, Brea, Calif. The literature for Dimetcote 9 reveals that it is an inorganic zinc material, principally zinc chromate, available in a solvent base at 62% solids content which cures by means of solvent release and reaction with atmospheric moisture. It is preferably applied by airless or conventional spray or by painting it onto the bridge deck. Other corrosion-resistant steel primers may also be used. Likewise, if the wear surface to be protected is not steel another, appropriate, primer for the particular wear surface material involved may be used.

In summary, the elastomer layer of the present invention should have the following characteristics:

(1) It should possess sufficient surface tack/adhesiveness to wet and subsequently bond to both the neoprene containing coating as well as the primer, should those materials be used.

(2) It should be compressible, resist cold flow, be shear resistant, be flexible at low temperature, and be resistant to sulfuric acid, oil, and salt water.

While the bonding system of the present invention is specifically designed for use with tiles and bridge decks, such as fiber-filled polyurethane tiles and steel bridge decks, it should be apparent that it can be used with other types of wear resistant overlays, including other plastic or ceramic tiles, and other underlying wear surfaces, including concrete bridge decks, floors and roads. It will, as in the situation involving polyurethane tiles and steel bridge decks, bond the wear resistant overlay to the wear surfaces while bearing the stress provided by vehicles and other traffic. Thus, it has been found that while the pressure from heavy vehicles is enormous, the properly compounded elastomer layer is able to resist flow. Besides, during ordinary usage, the traffic flow results in only brief periods of heavy pressure, and permanent deformation of the elastomer layer is, thus, avoided.

Accordingly, it is an object of the present invention to provide an elastomer layer which is usable for bonding wear resistant overlays to underlying wear surfaces under these conditions.

Other objects and advantages of that invention will be apparent from the following description, the accompanying drawings, and the appended claims.

BRIEF DESCRIPTION OF THE DRAWING

The FIGURE shows a cross-section of the preferred bonding system of the present invention as used on a bridge deck.

DESCRIPTION OF THE PREFERRED EMBODIMENTS

Referring to the drawing, the numeral 10 identifies a fiber-filled polyurethane tile, i.e., the wear-resistant layer. A coating layer 11 is positioned between tile 10 and an elastomer layer 12 which is placed on a bridge deck 13, i.e., the wear surface, which has been coated with primer 14. A coating layer 15, which may be identical to coating layer 11, is positioned between elastomer layer 12 and the primed bridge deck 13. Coating layer 11 is preferrably applied to tile 10 and coating layer 15 to the primed bridged deck 13. This is the assembly which is subjected to pressure to provide the system of this invention.

The following examples illustrate the best mode for carrying out the invention.

EXAMPLE 1 (BRIDGE DECK PRIMER)

When a steel bridge deck is the wear surface involved, use of a corrosion-resistant primer is desirable. As mentioned previously, this preferred primer is Dimetcote 9, commercially available from Ameron Corp., Protective Coatings Division, Brea, Calif. Generally, this is to be applied by painting (brush coating) the solvent-based primer onto the bridge deck in a one coat application.

EXAMPLE 2 (DECK TILE COATING)

A Shar mixer which includes a high speed central agitator and a peripheral scrapper is charged with 1920 pounds of methyl ethyl ketone followed by the addition of 126 pounds of terpene-phenolic resin (Nirez-2040) while the mixer is running to provide a resin solution. 120 pounds of Neoprene W (du Pont) are added and the mixer is run for 2 hours to dissolve the neoprene. 2 pounds of amino silane adhesion promoter are then added and mixed in for 10 minutes. Lastly, 84 pounds of hydrophobic fumed silica are added and mixed in to provide a homogenous mix having a viscosity of 15–35 seconds in a No. 4 Ford Cup at 77° F.

EXAMPLE 3 (PRODUCTION OF ELASTOMER LAYER)

Charge a Day mixer with 235 pounds of high molecular weight butyl rubber (Mooney viscosity of 50–60 Mooney points measured at 127° C.) and then add 429 pounds of cross-linked butyl rubber (cross-linked with divinyl benzene to be about 20% soluble in cyclohexane). Then add 96 pounds of acrylic elastomer (bulk copolymer of ethyl acrylate and n-butyl acrylate having a $T_g$ of −18° C.), 65 pounds of para-octyl phenolformaldehyde nonheat hardening phenolic resin, and 17 pounds of aluminum stearate, 100 pounds of polybutene (viscosity 3100 centistokes at 210° F.), and 200 pounds of N-330 carbon black, and operate the mixer for 1 hour to insure intimate admixture.

At this point add 105 pounds of additional polybutene (3100 centistokes) and mix in for 10 minutes and then add 200 pounds of the N-330 carbon black and 100 pounds of lower viscosity polybutene (110 centistokes at 100° F.) followed by 10 minutes of mixing.

Then add 100 pounds of additional polybutene (110 centistokes) and 200 pounds of N-330 carbon black and mix in for another 10 minutes.

Then add 100 pounds of additional polybutene 110 centistokes) and 115 pounds of N-330 carbon black and mix in for another 10 minutes.

Then add 100 pounds of additional polybutene (110 centistokes, 130 pounds of precipitated hydrated silica (Hi Sil 233 from PPG Industries) and mix for another 10 minutes.

Then add 77 pounds of additional polybutene (110 centistokes) and mix for 15 minutes and then add 65 pounds of calcium oxide and mix 15 minutes, and then add 65 pounds of talc and mix in briefly (about 6 seconds), stop the mixer and dump the product.

The above provides the following composition:

| Component | Pounds |
|---|---|
| Cross-linked butyl rubber | 429 |
| High mol. wt. butyl rubber | 235 |
| Phenolic resin | 65 |
| N-330 carbon black | 715 |
| Precipitated silica | 130 |
| Polybutene (110 centistokes) | 477 |
| Polybutene (3100 centistokes) | 205 |
| Calcium oxide | 65 |
| Talc | 65 |
| Aluminum stearate | 17 |
| Acrylic elastomer | 96 |

The mixing is done with water cooling in the cooling jacket. Despite this cooling, the temperature increases so that, when the product is dumped, it has a temperature of about 250° F.

EXAMPLE 4 (APPLICATION)

The steel deck is prepared by removing any surface contaminants such as oil or grease with a solvent such as toluol, mineral spirits, VM & P naptha or other appropriate solvents. A sand blasting operation can also be used in place of or in conjunction with the solvent removal to achieve a clear "white" metal wear surface free from rust, oil, grease, grit, etc.

When the wear surface is completely dry, free of moisture, soil, dust, grit and any other contaminants, the Dimetcote 9 primer of Example 1 is applied preferably as a one coat application. After the primer has dried, it is overcoated with the Deck Tile coating of example 2. Preferably a minimum of 0.30 gallon/100 ft.$^2$ of area is used. Again, this is preferably as a one coat application.

After the coating has dried the elastomer layer of Example 3, preferably as a tape or sheet, is layed on the primed, coated bridge deck. It is desirable to overlap the edges of the sheets of elastomer layer so that water does not seep through the elastomer layer and contact the primed, coated bridge deck. While it is also possible to place appropriately sized segments of the elastomer layer on the coated undersurface of the deck tile and, then, arrange the tiles on the primed and/or coated bridge deck (as disclosed in the parent application), it has been found that this system may permit water to seep through the elastomer layer between the abutting tiles and reach the bridge deck surface. Therefore, the overlapping sheet approach to placement of the elastomer layer is now preferred.

Once the elastomer is in place, the deck tiles are arranged on the bridge deck. The tile is preferably a Delprene Deck Tile from The D. S. Brown Co., N. Baltimore, Ohio. Also, preferably, any contaminants are removed from the undersurface of the deck tile using solvents of the same type used to clean the bridge deck, that surface dusted and air dried, and, then, coated with the coating of Example 2 prior to being arranged on the bridge deck. The coating of Example 2 can be applied to the prepared undersurface of the deck tile with a paint roller or brush. It is desirable that it is applied when the ambient temperature is 60° F. or above and the relative humidity is less than 65%. The coating should be allowed to dry at least to the stage where it loses its wet appearance and acquires a dull, non-shing surface before the tiles are arranged on the bridge deck.

After the tiles are in place, pressure is applied to assemble the systems. It is also desirable that a sealant, such as a polyurethane elastomer or other known sealant, be applied to the gaps between the abutting desk tiles after they have been arranged and adhered to the bridge decks. This has been found to add extra protection against leakage of water between the deck tiles.

Separating sheets may be used to prevent the elastomer layer from stacking prematurely, but the dried coating on either the bridge deck or the tiles need not be protected as long as it is kept clean prior to use.

What is claimed is:

1. A wear surface having a wear-resistant overlay bonded thereto by means of an elastomer layer having a Shore 00 hardness of approximately 78 to 90, said elastomer layer being compounded with a stiffening filler in an amount at least equal to about half the weight of the elastomer, and low volatile liquid plasticizer in an amount sufficient to provide the stated hardness.

2. The wear surface of claim 1 further including a coating positioned between said wear-resistant overlay and said elastomer layer, said coating comprising neoprene in admixture with a terpene-phenolic resin in a weight ratio of from 1:3 to 3:1.

3. The wear surface of claim 1 wherein said elastomer being a mixture of acrylic elastomer and butyl elastomers in the weight ratio range of from 1:10 to 1:4, said acrylic elastomer being a bulk copolymer of acrylates and methacrylates providing a $T_g$ in the range of −10° C. to −40° C., said butyl elastomers comprising a mixture of butyl rubber having a molecular weight of at least 300,000 and a butyl rubber cross-linked to about 15% to about 25% solubility in cyclohexane, and said stiffening filler being a high abrasion furnace carbon black.

4. The wear surface of claim 1 wherein said wear-resistant overlay is made up of a number of fiber-reinforced polyurethane tiles.

5. The wear surface of claim 2 further including a coating positioned between said elastomer layer and said wear surface, said coating comprising neoprene in admixture with a terpene-phenolic resin in a weight ratio of from 1:3 to 3:1.

6. A wear surface having a wear-resistant overlay bonded thereto by means of an elastomer layer having a Shore 00 hardness of 60 to 95 such that said elastomer is able to withstand vehicular traffic over said wear-resistant layer without the impact of passing vehicles squeezing the elastomer layer out from between the wear surface and the wear-resistant overlay, said elastomer being a mixture of acrylic elastomer and butyl elastomers in the weight ratio range of from 1:10 to 1:4, said acrylic elastomer being a bulk copolymer of acrylates and methacrylates providing a $T_g$ in the range of −10° C. to −40° C., said butyl elastomers comprising a mixture of butyl rubber having a molecular weight of at least 300,000 an a butyl rubber cross-linked to about 15% to about 25% solubility in cyclohexane, said stiffening filler being a high abrasion furnace carbon black, and a low volatile liquid plasticizer is present in an amount to provide the stated hardness.

* * * * *